US006857341B1

(12) United States Patent
Cheng

(10) Patent No.: US 6,857,341 B1
(45) Date of Patent: Feb. 22, 2005

(54) F-TYPE WRENCH STRUCTURE

(76) Inventor: Chin Shun Cheng, No. 22, Lane 427, Dasheng Street, Nantun District, Taichung City 408 (TW)

( * ) Notice: Subject to any disclaimer, the term of this patent is extended or adjusted under 35 U.S.C. 154(b) by 0 days.

(21) Appl. No.: 10/759,948

(22) Filed: Jan. 16, 2004

(51) Int. Cl.[7] ..... B25B 23/16
(52) U.S. Cl. ..... 81/177.8; 81/177.9; 81/177.7
(58) Field of Search ..... 81/177.6, 177.7, 81/177.8, 177.85, 177.9; 403/324, 325, 328

(56) References Cited

U.S. PATENT DOCUMENTS 4,692,049 A * 9/1987 Engle ..... 403/1
4,711,145 A * 12/1987 Inoue ..... 81/177.1
5,390,571 A * 2/1995 Fox et al. ..... 81/177.85
5,531,140 A * 7/1996 Chow ..... 81/177.85
6,000,302 A * 12/1999 Chiang ..... 81/177.8
6,006,632 A * 12/1999 Hsieh ..... 81/177.85
6,131,490 A * 10/2000 Lee ..... 81/163.1
6,216,567 B1 * 4/2001 Hu ..... 81/177.9
6,220,125 B1 * 4/2001 Lan ..... 81/177.9
6,405,621 B1 * 6/2002 Krivec et al. ..... 81/177.9
6,557,442 B1 * 5/2003 Owoc ..... 81/177.9
6,755,100 B1 * 6/2004 Chen ..... 81/177.85
2003/0110907 A1 * 6/2003 Hu ..... 81/177.85

* cited by examiner

*Primary Examiner*—David B. Thomas

(57) ABSTRACT

A wrench structure includes a body, a rotation member, a drive rod, a press rod, and an elastic member. The rotation member is rotated relative to the body freely so as to adjust the included angle between the rotation member and the body arbitrarily. Thus, the operation angle of the wrench structure can be adjusted arbitrarily, thereby facilitating the user operating the wrench structure. In addition, the drive rod is limited by the rotation member, so that the drive rod is received in the body without detachment. Further, the press rod is limited by the drive rod, so that the press rod is received in the body without detachment.

18 Claims, 24 Drawing Sheets

F-TYPE WRENCH STRUCTURE

BACKGROUND OF THE INVENTION

1. Field of the Invention

The present invention relates to an F-type wrench structure, and more particularly to a wrench structure whose operation angle can be adjusted arbitrarily, thereby facilitating the user operating the wrench structure.

2. Description of the Related Art

A conventional F-type wrench in accordance with the prior art is disclosed in U.S. Pat. No. 6,216,567-B1, U.S. Pat. No. 6,220,125-B1, U.S. Pat. No. 6,405,621-B1, U.S. Pat. No. 6,131,490, and U.S. Pat. No. 4,711,145. The conventional F-type wrench has an angle adjustable structure.

SUMMARY OF THE INVENTION

The primary objective of the present invention is to provide a wrench structure whose operation angle can be adjusted arbitrarily, thereby facilitating the user operating the wrench structure.

Another objective of the present invention is to provide a wrench structure, wherein the rotation member is rotated relative to the body freely so as to adjust the included angle between the rotation member and the body arbitrarily.

A further objective of the present invention is to provide a wrench structure, wherein the drive rod is limited by the rotation member, so that the drive rod is received in the body without detachment.

A further objective of the present invention is to provide a wrench structure, wherein the press rod is limited by the drive rod, so that the press rod is received in the body without detachment.

Further benefits and advantages of the present invention will become apparent after a careful reading of the detailed description with appropriate reference to the accompanying drawings.

DETAILED DESCRIPTION OF THE INVENTION

Figure 1:
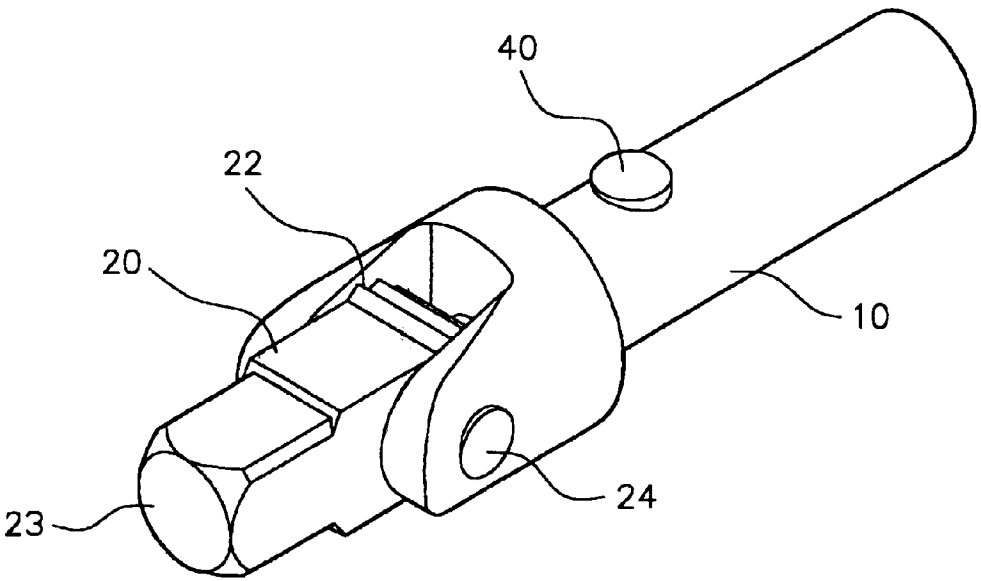
FIG. 1 is a perspective view of a wrench structure in accordance with the preferred embodiment of the present invention.
Figure 2:
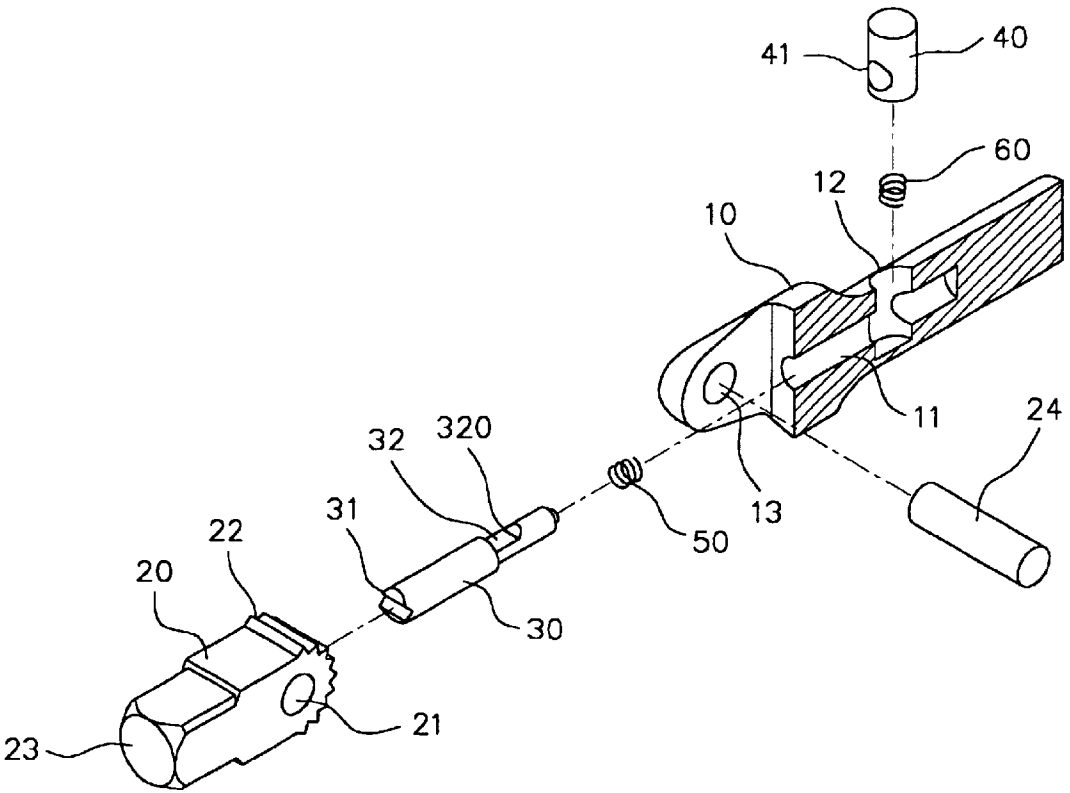
FIG. 2 is a partially cross-sectional exploded perspective view of the wrench structure as shown in FIG. 1.

Referring to the drawings and initially to FIGS. 1–4, a wrench structure in accordance with the preferred embodiment of the present invention, comprises a body 10, a rotation member 20, a drive rod 30, a press rod 40, a first elastic member 50, and a second elastic member 60.

The body 10 has an inside formed with an axial receiving hole 11 and has a peripheral wall formed with a transverse limit hole 12 communicating with the receiving hole 11. The body 10 has a substantially U-shaped opened end formed with two pivot holes 13. The receiving hole 11 of the body 10 is extended to the opened end of the body 10.

The rotation member 20 is rotatably mounted on the body 10 and has a first end formed with a plurality of ratchet teeth 22 arranged in an annular manner and a second end formed with a driving head 23. The first end of the rotation member 20 is pivotally mounted on the opened end of the body 10 and is formed with a pivot hole 21, and the wrench structure further comprises a pivot shaft 24 extended through the two pivot holes 13 of the body 10 and the pivot hole 21 of the rotation member 20.

The drive rod 30 is movably mounted in the receiving hole 11 of the body 10 and has a first end formed with a plurality of engaging teeth 31 meshing with the ratchet teeth 22 of the rotation member 20 and a second end formed with a groove 32 facing the limit hole 12 of the body 10. The groove 32 of the drive rod 30 has a side formed with an oblique face 320.

The press rod 40 is movably mounted in the limit hole 12 of the body 10 and has a first end formed with a through hole 41 mounted on the drive rod 30 and aligned with the groove 32 of the drive rod 30. The press rod 40 has a second end protruded outward from the limit hole 12 of the body 10. The through hole 41 of the press rod 40 has a wall that is movable to press the oblique face 320 of the drive rod 30 so as to move the drive rod 30 away from the rotation member 20, thereby detaching the engaging teeth 31 of the drive rod 30 from the ratchet teeth 22 of the rotation member 20.

The first elastic member 50 is mounted in the receiving hole 11 of the body 10 and is urged between the second end of the drive rod 30 and the body 10.

The second elastic member 60 is mounted in the limit hole 12 of the body 10 and is urged between the first end of the press rod 40 and the body 10.

Figure 3:
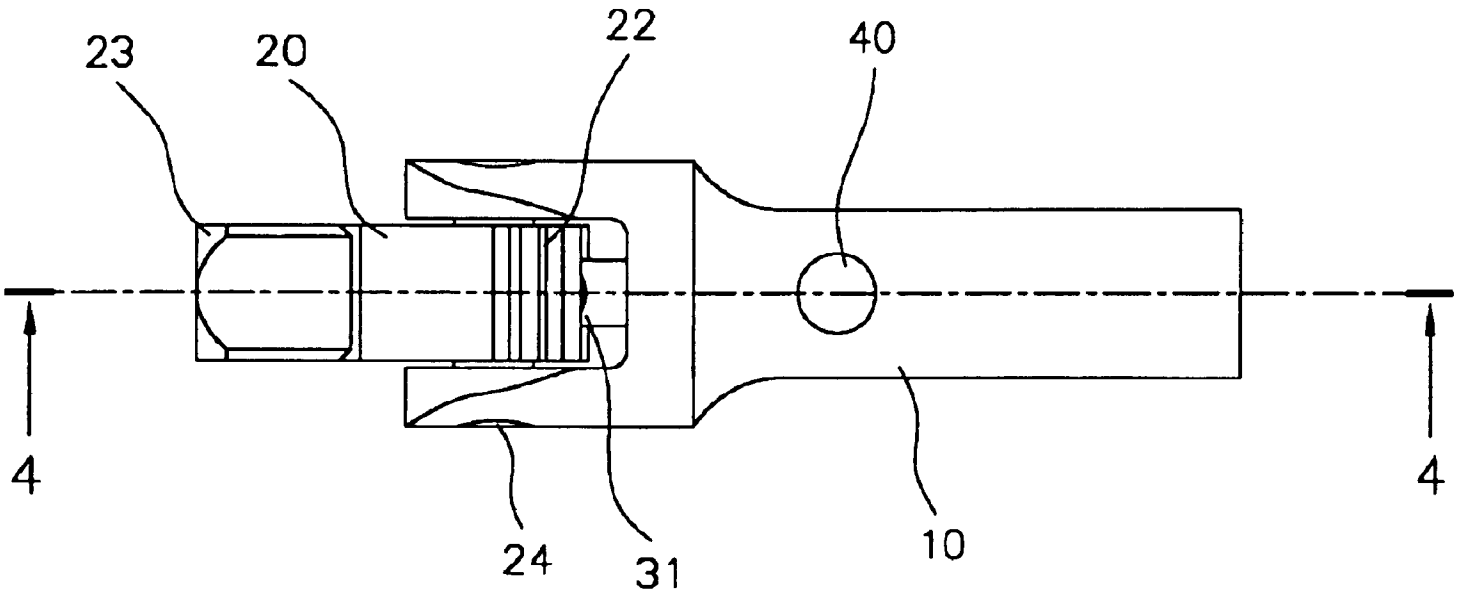
FIG. 3 is a top plan view of the wrench structure as shown in FIG. 1.
Figure 4:
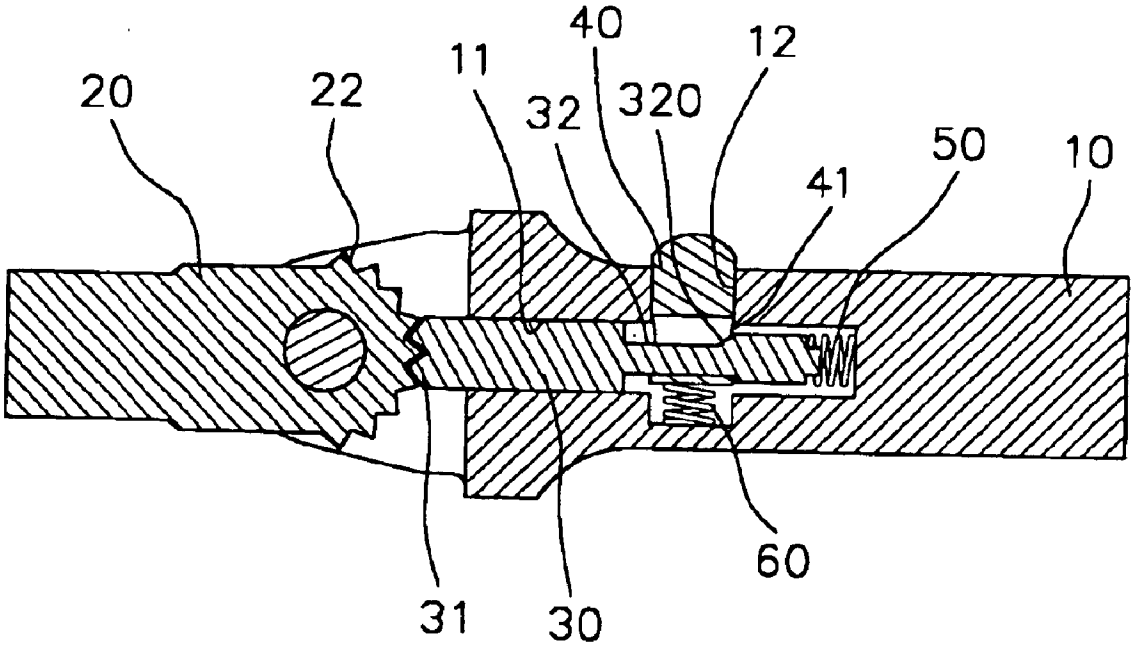
FIG. 4 is a plan cross-sectional view of the wrench structure taken along line 4—4 as shown in FIG. 3.

In operation, as shown in FIGS. 3 and 4, the drive rod 30 is moved toward the rotation member 20 by the elastic force of the first elastic member 50, so that the engaging teeth 31 of the drive rod 30 mesh with the ratchet teeth 22 of the rotation member 20. In addition, the press rod 40 is pressed outward from the body 10 by the elastic force of the second elastic member 60, so that the wall of the through hole 41 of the press rod 40 is released from the oblique face 320 of the drive rod 30.

Figure 5:
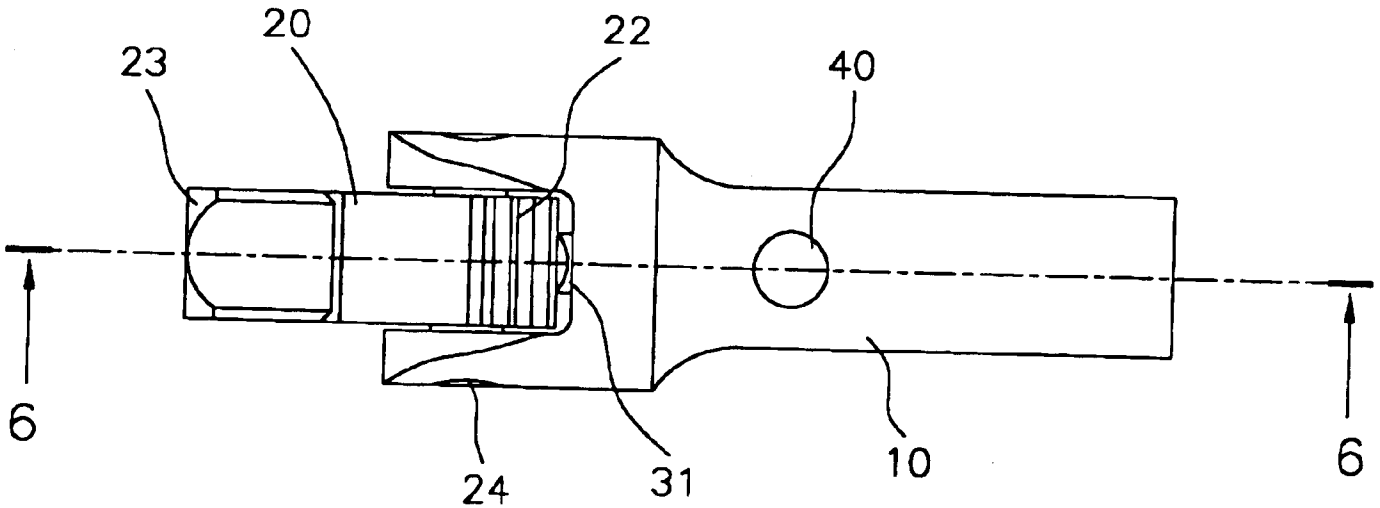
FIG. 5 is a schematic operational view of the wrench structure as shown in FIG. 3.
Figure 6:
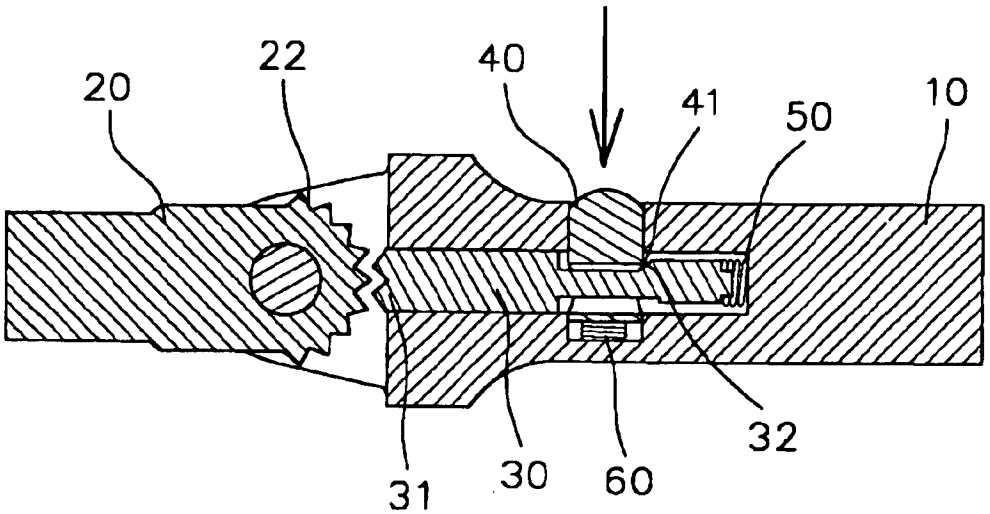
FIG. 6 is a plan cross-sectional view of the wrench structure taken along line 6—6 as shown in FIG. 5.

As shown in FIGS. 5 and 6, the press rod 40 is pressed toward the body 10 to overcome the elastic force of the second elastic member 60, so that the wall of the through hole 41 of the press rod 40 is urged on the oblique face 320 of the drive rod 30 to overcome the elastic force of the first elastic member 50, so as to move the drive rod 30 away from the rotation member 20, thereby detaching the engaging teeth 31 of the drive rod 30 from the ratchet teeth 22 of the rotation member 20.

Thus, the rotation member 20 is rotated relative to the body 10 freely so as to adjust the included angle between the rotation member 20 and the body 10 arbitrarily.

Figure 7:
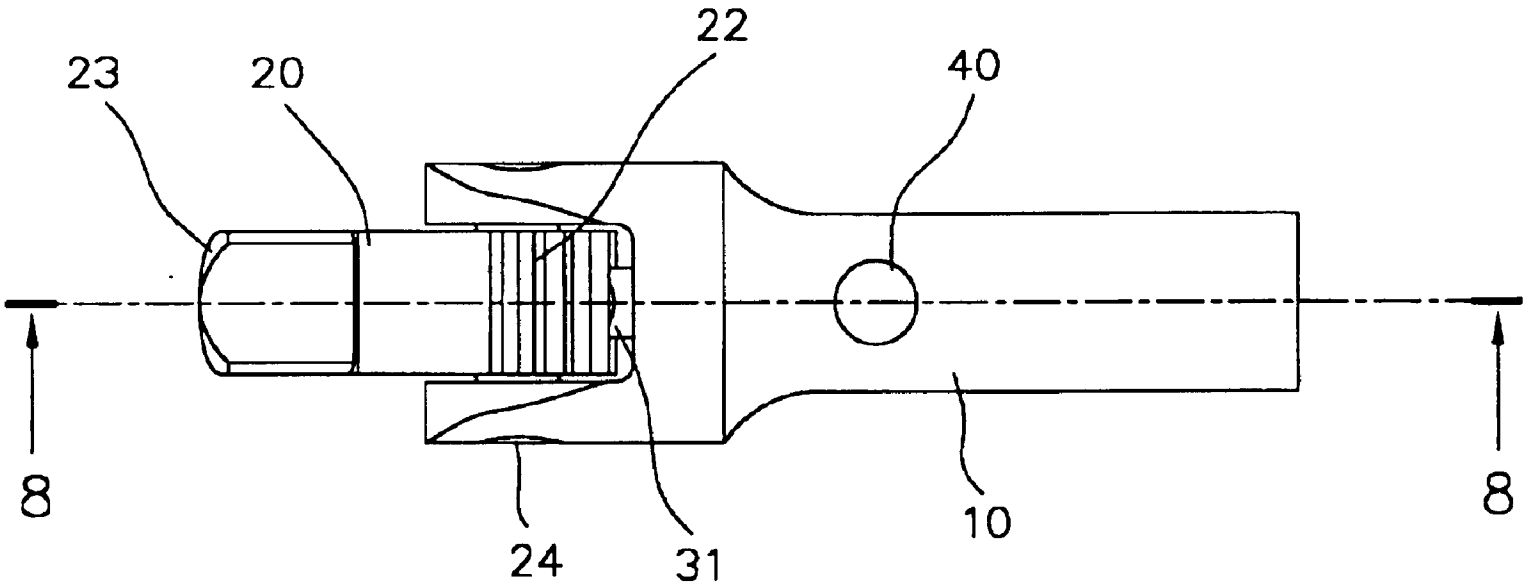
FIG. 7 is a schematic operational view of the wrench structure as shown in FIG. 5.
Figure 8:
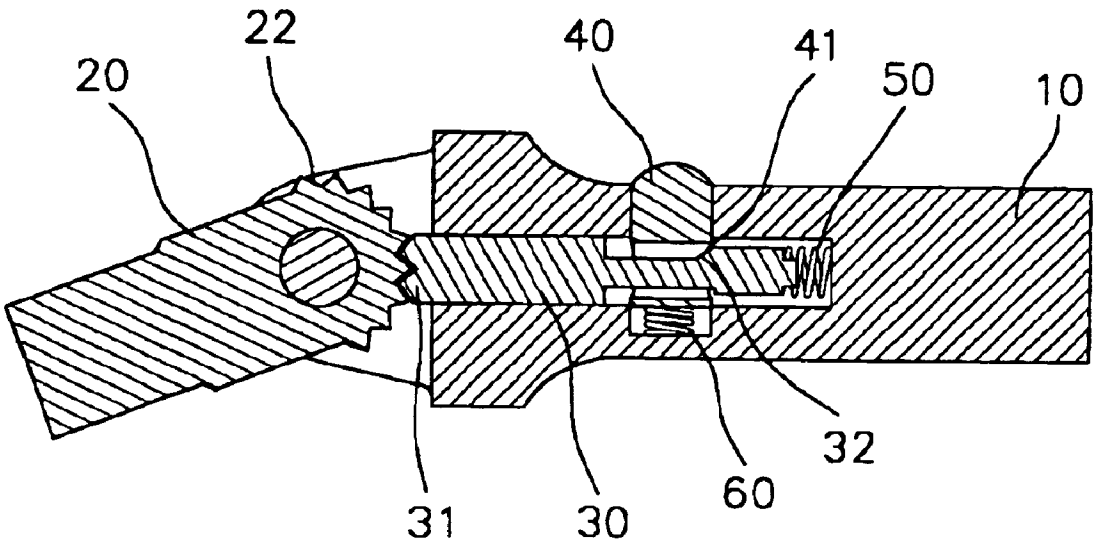
FIG. 8 is a plan cross-sectional view of the wrench structure taken along line 8—8 as shown in FIG. 7.

As shown in FIGS. 7 and 8, after the included angle between the rotation member 20 and the body 10 is adjusted, the force applied on the press rod 40 is removed. Thus, the press rod 40 is pressed outward from the body 10 by the elastic force of the second elastic member 60, so that the wall of the through hole 41 of the press rod 40 is released from the oblique face 320 of the drive rod 30. In addition, the drive rod 30 is moved toward the rotation member 20 by the elastic force of the first elastic member 50, so that the engaging teeth 31 of the drive rod 30 mesh with the ratchet teeth 22 of the rotation member 20.

Accordingly, the included angle between the rotation member 20 and the body 10 can be adjusted arbitrarily. In addition, the drive rod 30 is limited by the rotation member 20, so that the drive rod 30 is received in the body 10 without detachment. Further, the press rod 40 is limited by the drive rod 30, so that the press rod 40 is received in the body 10 without detachment.

Figure 9:
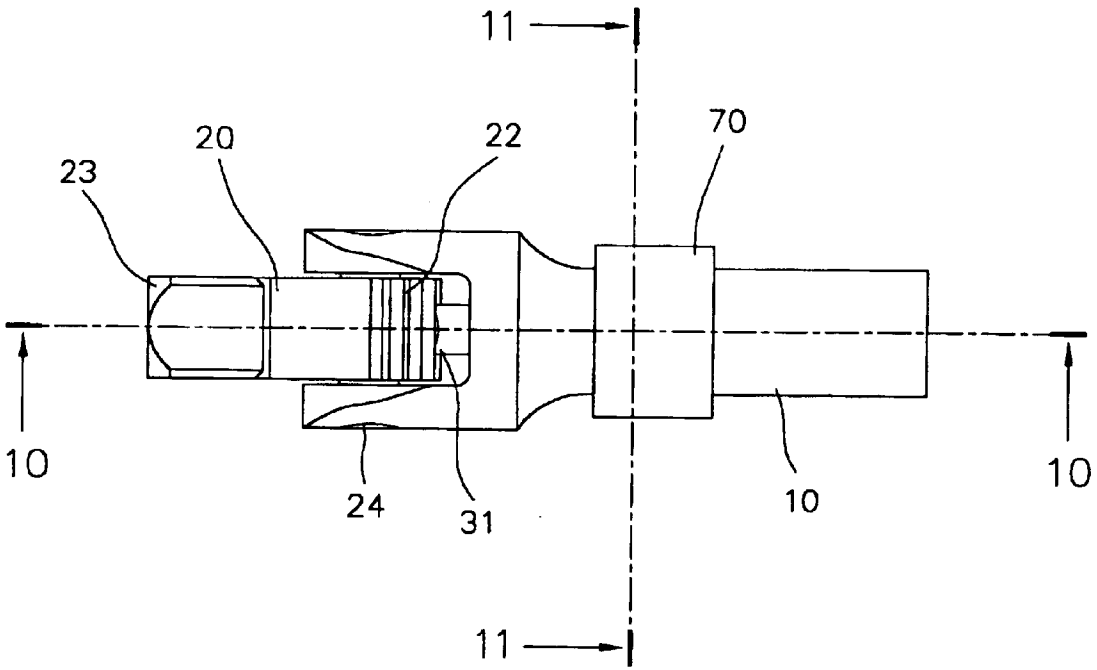
FIG. 9 is a top plan view of a wrench structure in accordance with another embodiment of the present invention.
Figure 10:
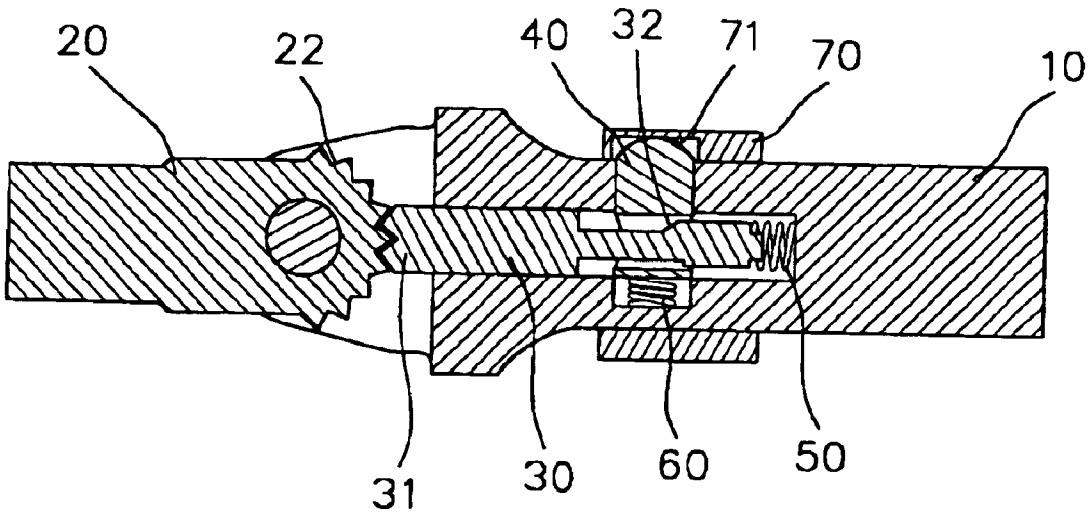
FIG. 10 is a plan cross-sectional view of the wrench structure taken along line 10—10 as shown in FIG. 9.
Figure 11:
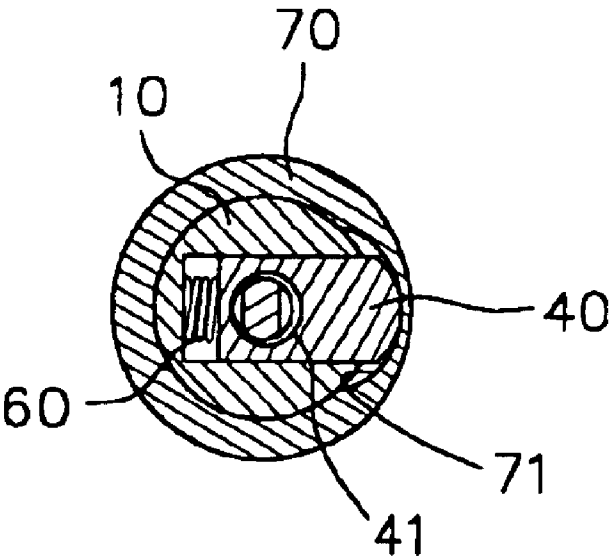
FIG. 11 is a plan cross-sectional view of the wrench structure taken along line 11—11 as shown in FIG. 9.

Referring to FIGS. 9–11, the wrench structure further comprises a control ring 70 rotatably mounted on the body 10 and having an inner wall formed with an arc-shaped urging face 71 that is movable to press the press rod 40 toward the body 10.

Figure 12:
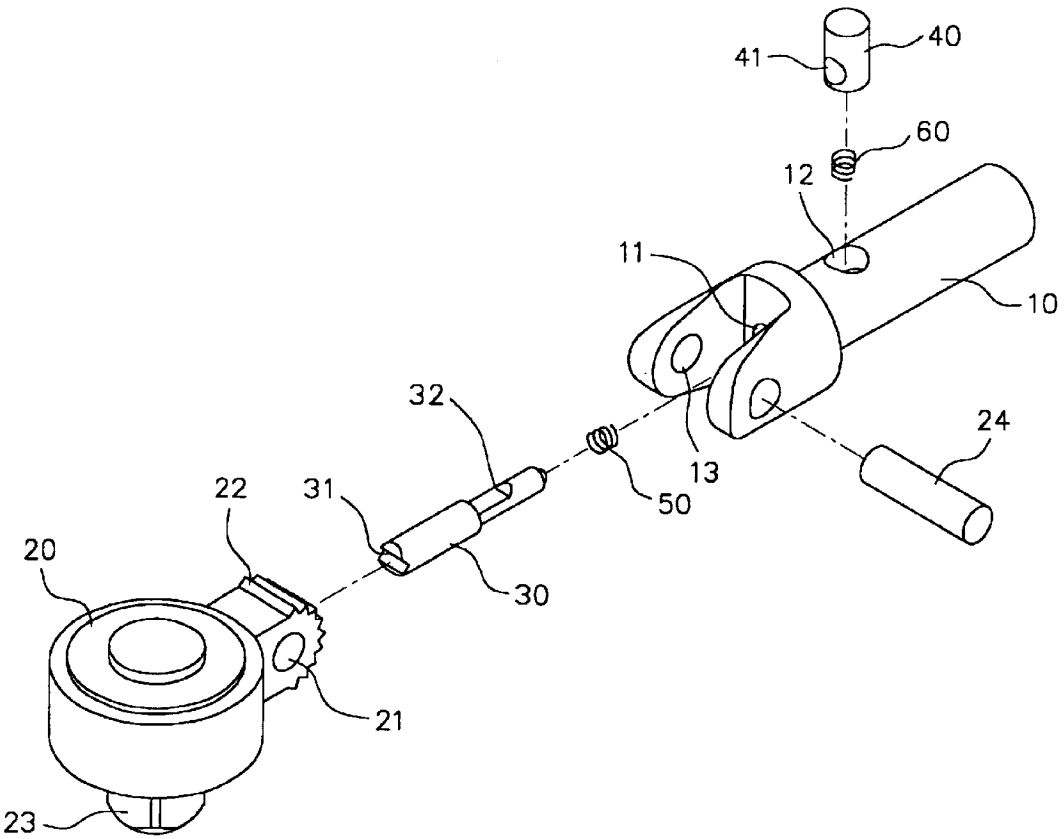
FIG. 12 is an exploded perspective view of a wrench structure in accordance with another embodiment of the present invention.

As shown in FIG. 12, the rotation member 20 has a different shape, so that the wrench structure can function as a ratchet wrench.

Figure 13:
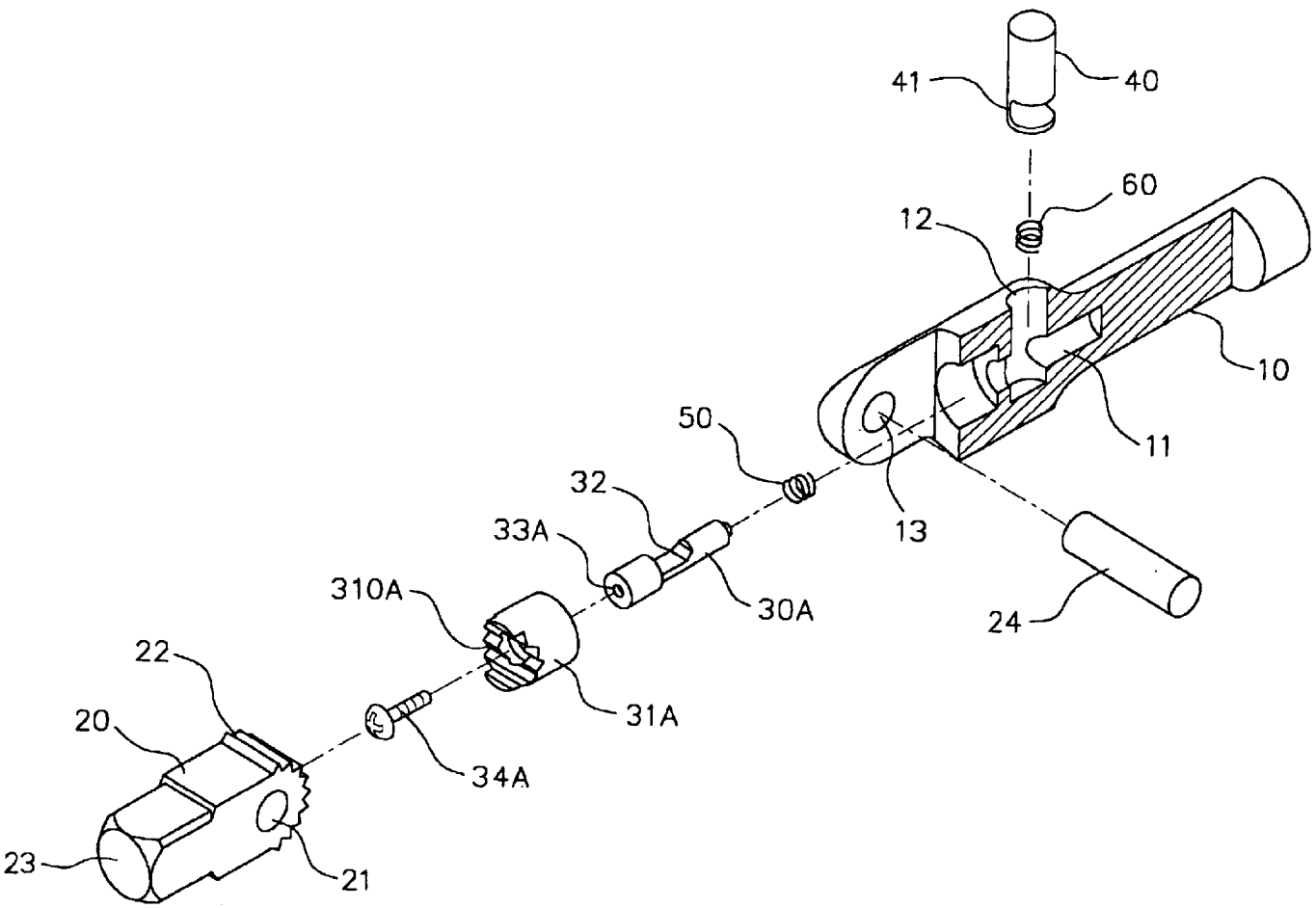
FIG. 13 is an exploded perspective view of a wrench structure in accordance with another embodiment of the present invention.

Referring to FIG. 13, the first end of the drive rod 30A is formed with a screw bore 33A, and the wrench structure further comprises a mounting head 31A mounted on the first end of the drive rod 30A and formed with a plurality of engaging teeth 310A meshing with the ratchet teeth 22 of the rotation member 20, and a screw member 34A extended through the mounting head 31A and screwed into the screw bore 33A of the drive rod 30A.

Figure 14:
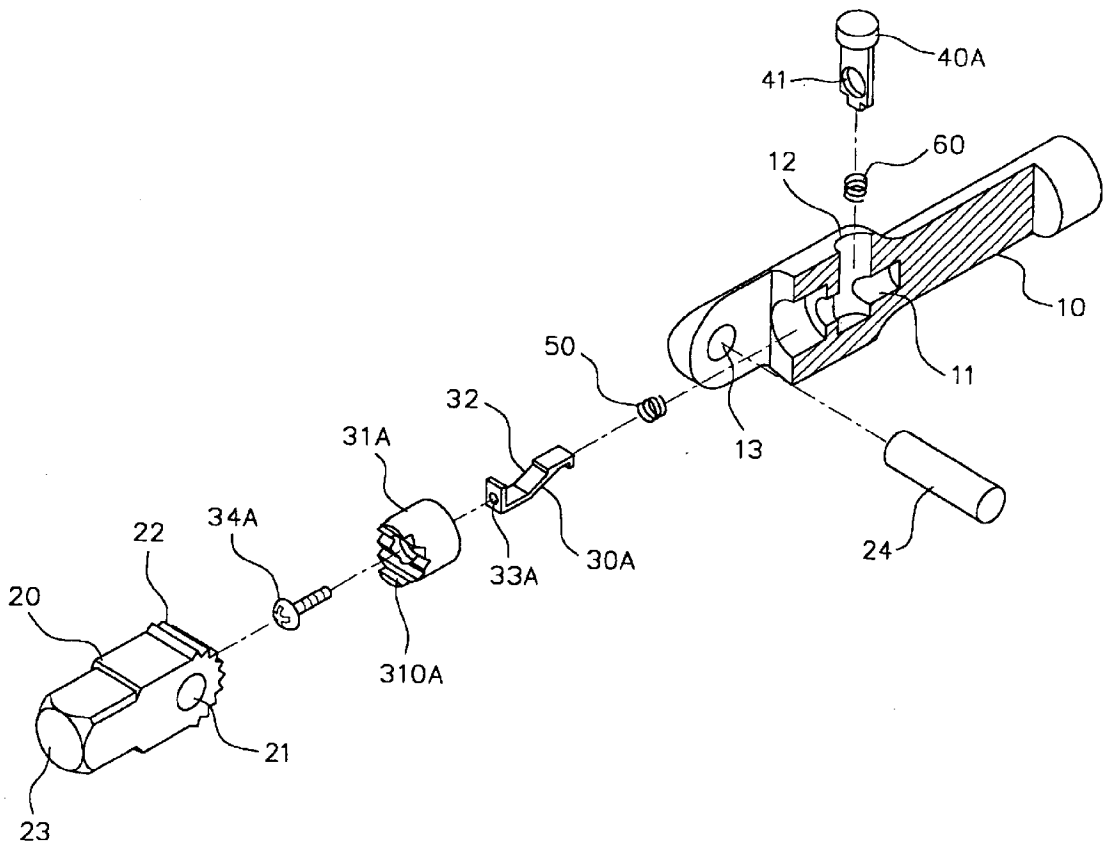
FIG. 14 is an exploded perspective view of a wrench structure in accordance with another embodiment of the present invention.
Figure 15:
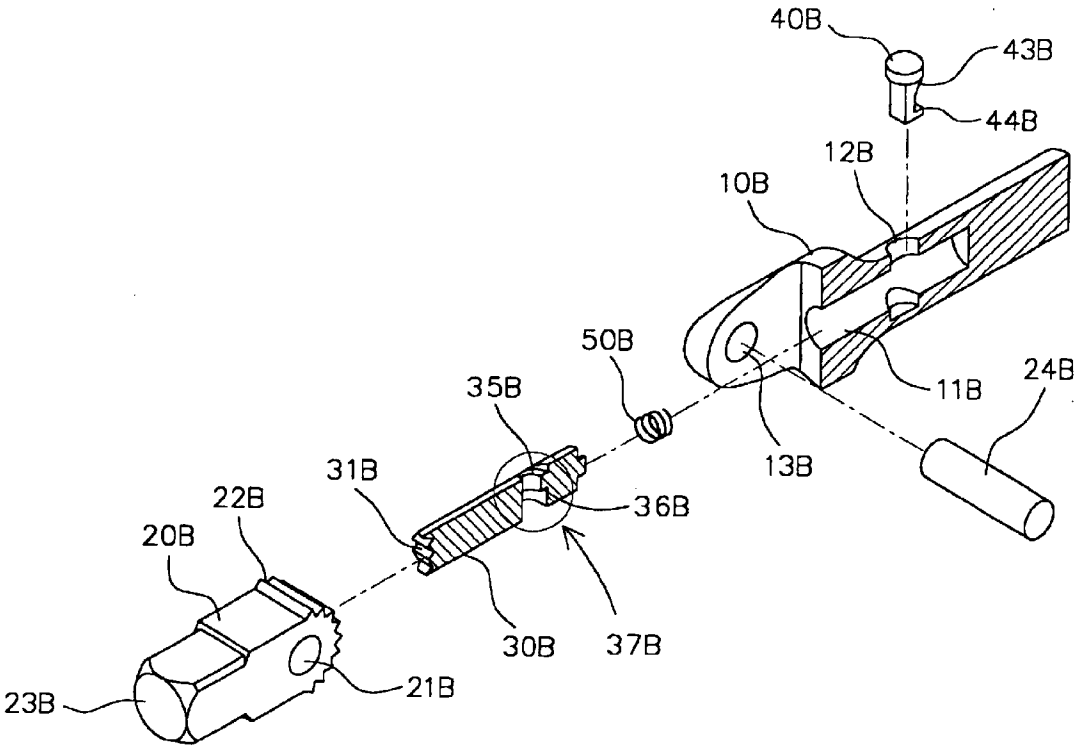
FIG. 15 is an exploded perspective view of a wrench structure in accordance with another embodiment of the present invention.
Figure 16:
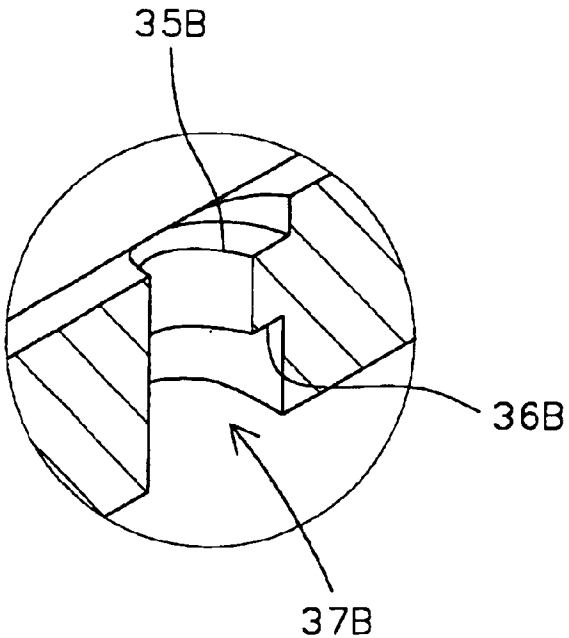
FIG. 16 is a partially enlarged view of the wrench structure as shown in FIG. 15.

Referring to FIG. 14, the press rod 40 has a plate shape, and the drive rod 30A has a plate shape.

Referring to FIGS. 15–19, a wrench structure in accordance with another embodiment of the present invention comprises a body 10B, a rotation member 20B, a drive rod 30B, a press rod 40B, and an elastic member 50B.

The body 10B has an inside formed with a receiving hole 11B and has a peripheral wall formed with a limit hole 12B communicating with the receiving hole 11B. The body 10B has a substantially U-shaped opened end formed with two pivot holes 13B. The receiving hole 11B of the body 10B is extended to the opened end of the body 10B.

The rotation member 20B is rotatably mounted on the body 10B and has a first end formed with a plurality of ratchet teeth 22B arranged in an annular manner and a second end formed with a driving head 23B. The first end of the rotation member 20B is pivotally mounted on the opened end of the body 10B and is formed with a pivot hole 21B, and the wrench structure further comprises a pivot shaft 24B extended through the two pivot holes 13B of the body 10B and the pivot hole 21B of the rotation member 20B.

The drive rod 30B is movably mounted in the receiving hole 11B of the body 10B and has a first end formed with a plurality of engaging teeth 31B meshing with the ratchet teeth 22B of the rotation member 20B and a second end formed with a stepped hole 37B facing the limit hole 12B of the body 10B and having a first side formed with an arc-shaped press edge 35B and a second side formed with an arc-shaped resting edge 36B.

The press rod 40B is movably mounted in the limit hole 12B of the body 10B and the stepped hole 37B of the drive rod 30B and has a first end formed with an oblique face 43B rested on the press edge 35B of the drive rod 30B and a resting edge 44B rested on the resting edge 36B of the drive rod 30B. The press rod 40B has a second end protruded outward from the limit hole 12B of the body 10B.

The elastic member 50B is mounted in the receiving hole 11B of the body 10B and is urged between the second end of the drive rod 30B and the body 10B.

Figure 17:
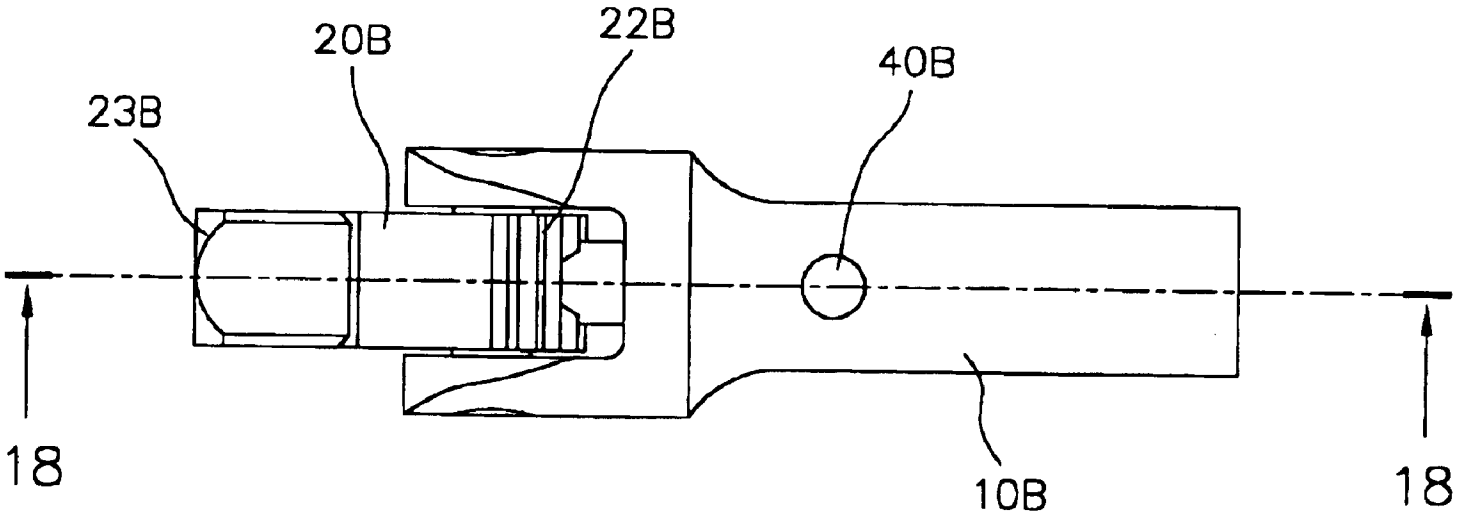
FIG. 17 is a top plan view of the wrench structure as shown in FIG. 15.
Figure 18:
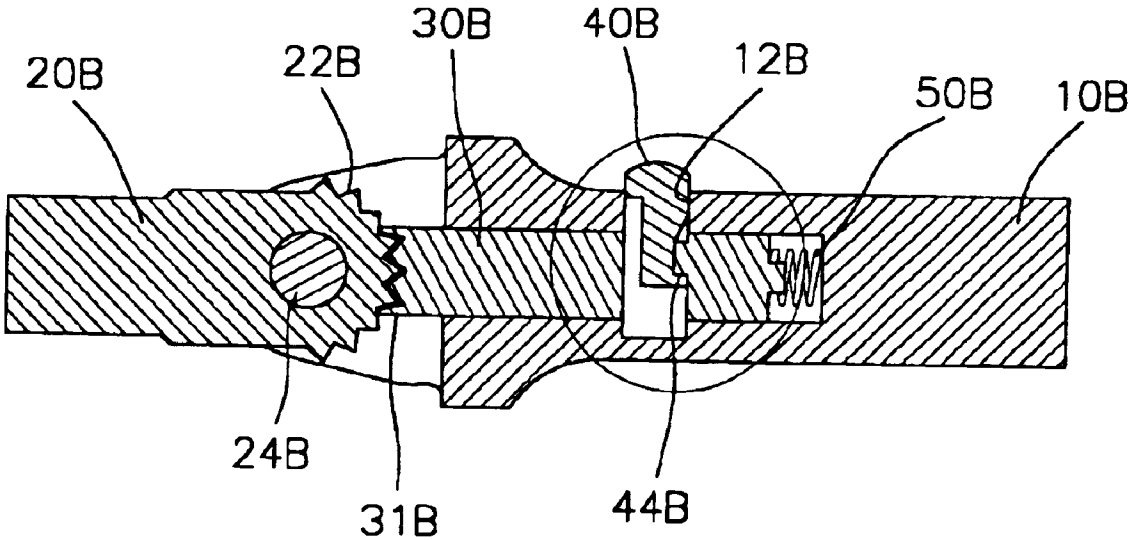
FIG. 18 is a plan cross-sectional view of the wrench structure taken along line 18—18 as shown in FIG. 17.
Figure 19:
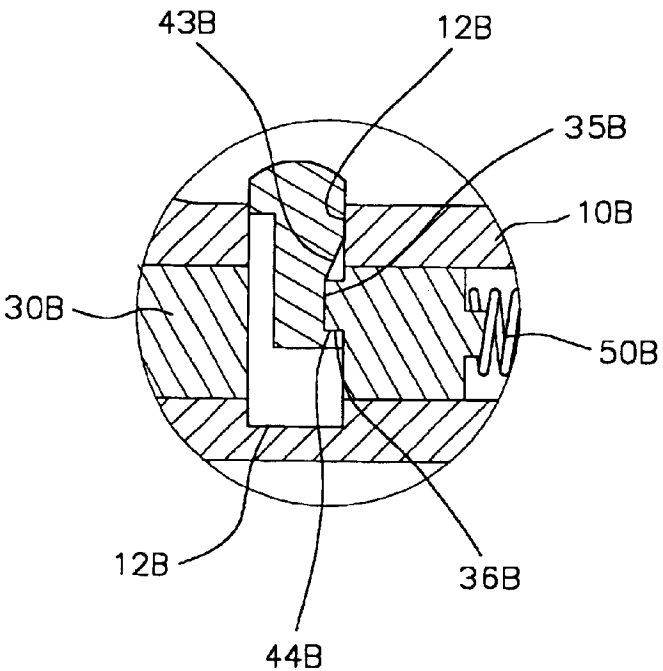
FIG. 19 is a partially enlarged view of the wrench structure as shown in FIG. 18.

In operation, as shown in FIGS. 17–19, the drive rod 30B is moved toward the rotation member 20B by the elastic force of the elastic member 50B, so that the engaging teeth 31B of the drive rod 30B mesh with the ratchet teeth 22B of the rotation member 20B. In addition, the press rod 40B is pressed outward from the body 10B by the drive rod 30B.

Figure 20:
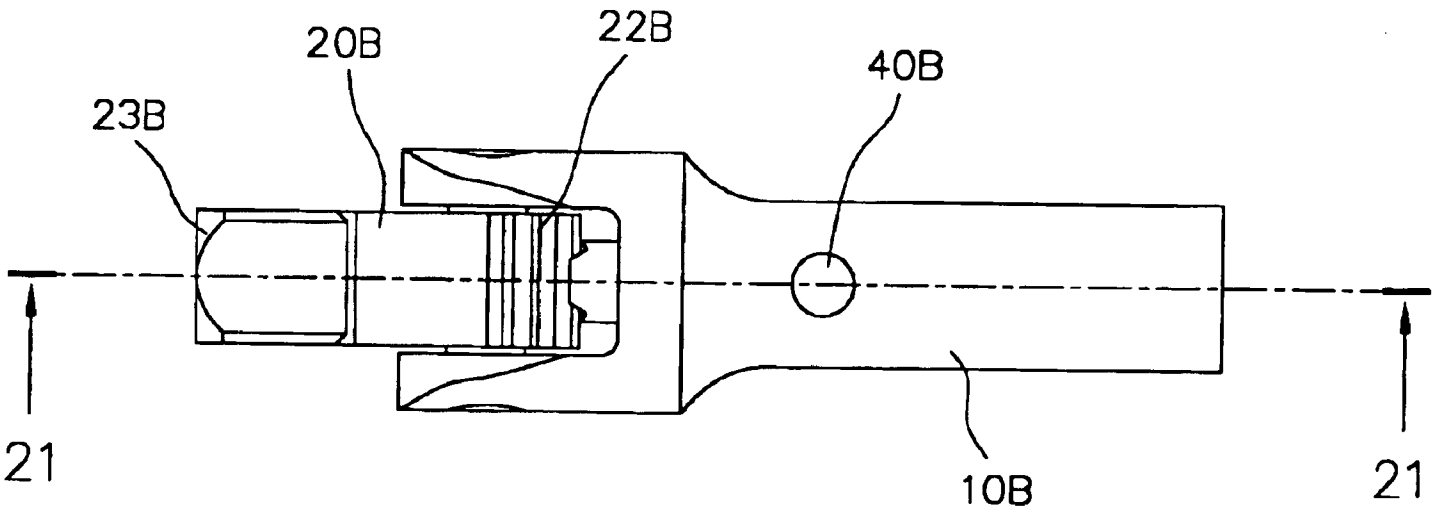
FIG. 20 is a schematic operational view of the wrench structure as shown in FIG. 17.
Figure 21:
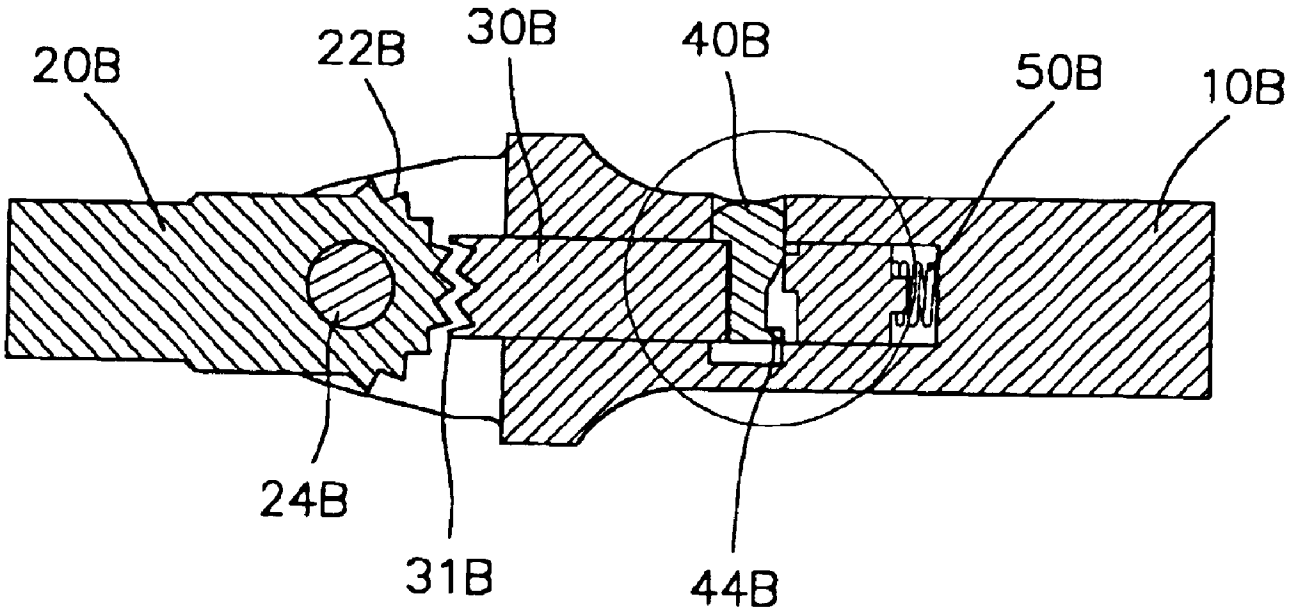
FIG. 21 is a plan cross-sectional view of the wrench structure taken along line 21—21 as shown in FIG. 20.
Figure 22:
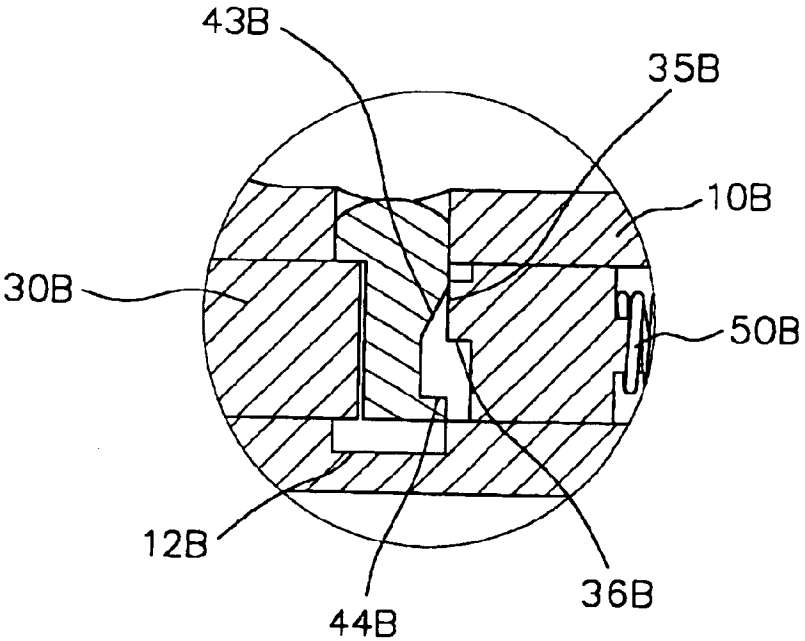
FIG. 22 is a partially enlarged view of the wrench structure as shown in FIG. 21.

As shown in FIGS. 20–22, the press rod 40B is pressed toward the body 10B to overcome the elastic force of the elastic member 50B, so that the oblique face 43B the press rod 40B is urged on the press edge 35B of the drive rod 30B to overcome the elastic force of the elastic member 50B, so as to move the drive rod 30B away from the rotation member 20B, thereby detaching the engaging teeth 31B of the drive rod 30B from the ratchet teeth 22B of the rotation member 20B.

Thus, the rotation member 20B is rotated relative to the body 10B freely so as to adjust the included angle between the rotation member 20B and the body 10B arbitrarily.

Figure 23:
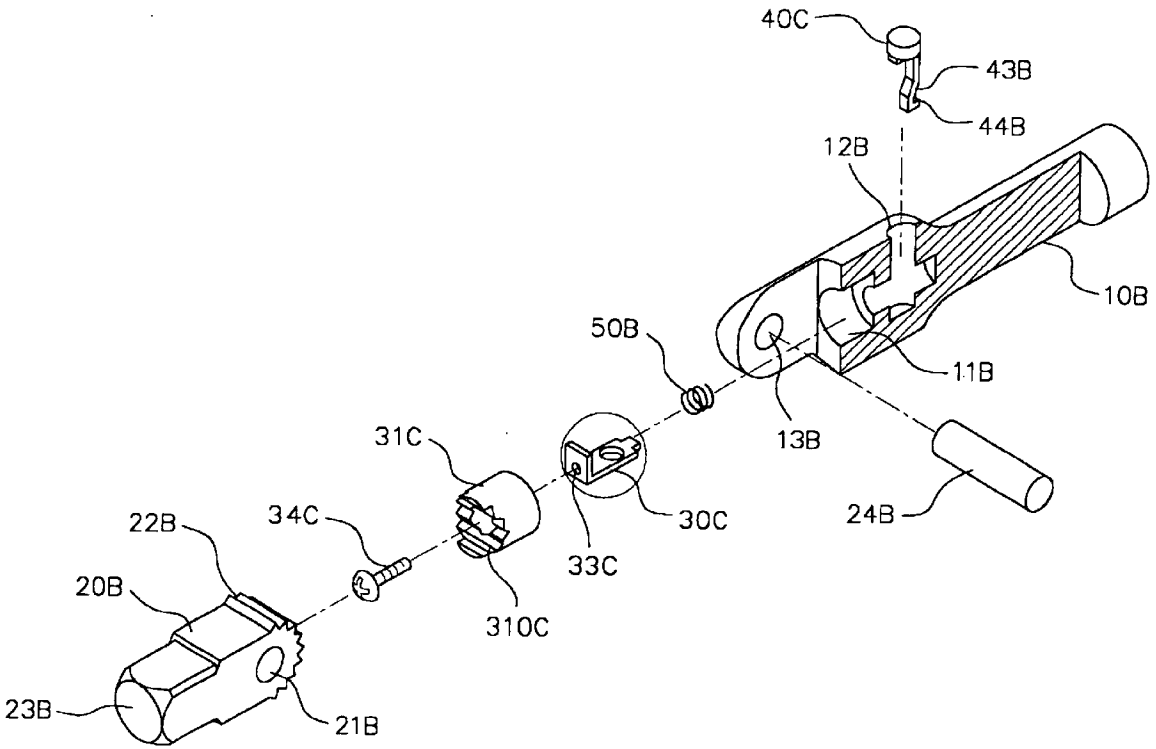
FIG. 23 is an exploded perspective view of a wrench structure in accordance with another embodiment of the present invention.
Figure 24:
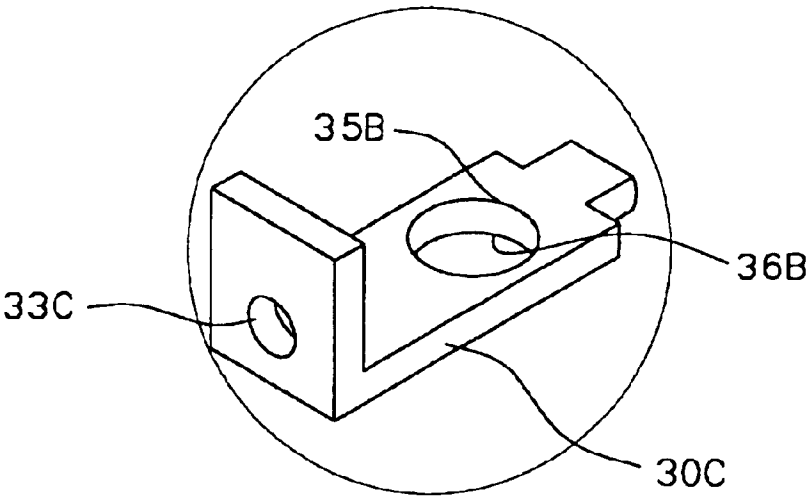
FIG. 24 is a partially enlarged view of the wrench structure as shown in FIG. 23.

As shown in FIGS. 23 and 24, the press rod 40C has a plate shape, the drive rod 30C has a plate shape, the first end of the drive rod 30C is formed with a screw bore 33C, and the wrench structure further comprises a mounting head 31C mounted on the first end of the drive rod 30C and formed with a plurality of engaging teeth, 310C meshing with the ratchet teeth 22 of the rotation member 20, and a screw member 34C extended through the mounting head 31C and screwed into the screw bore 33C of the drive rod 30C.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A wrench structure, comprising a body, a rotation member, a drive rod, and a press rod, wherein:

the body has an inside formed with an axial receiving hole and has a peripheral wall formed with a transverse limit hole communicating with the receiving hole;

the rotation member is rotatably mounted on the body and has a first end formed with a plurality of ratchet teeth arranged in an annular manner;

the drive rod is movably mounted in the receiving hole of the body and has a first end provided with a plurality of engaging teeth meshing with the ratchet teeth of the rotation member and a second end formed with a groove facing the limit hole of the body, the groove of the drive rod has a side formed with an oblique face; and the press rod is movably mounted in the limit hole of the body and has a first end formed with a through hole mounted on the drive rod and aligned with the groove of the drive rod, the through hole of the press rod has a wall that is movable to press the oblique face of the drive rod so as to move the drive rod away from the rotation member, thereby detaching the engaging teeth of the drive rod from the ratchet teeth of the rotation member.

2. The wrench structure in accordance with claim 1, wherein the body has a substantially U-shaped opened end formed with two pivot holes, the first end of the rotation member is pivotally mounted on the opened end of the body and is formed with a pivot hole, and the wrench structure further comprises a pivot shaft extended through the two pivot holes of the body and the pivot hole of the rotation member.

3. The wrench structure in accordance with claim 1, wherein the receiving hole of the body is extended to the opened end of the body.

4. The wrench structure in accordance with claim 1, wherein the rotation member has a second end formed with a driving head.

5. The wrench structure in accordance with claim 1, wherein the press rod has a second end protruded outward from the limit hole of the body.

6. The wrench structure in accordance with claim 1, further comprising a first elastic member mounted in the receiving hole of the body and urged between the second end of the drive rod and the body.

7. The wrench structure in accordance with claim 1, further comprising a second elastic member mounted in the limit hole of the body and urged between the first end of the press rod and the body.

8. The wrench structure in accordance with claim 1, further comprising a control ring rotatably mounted on the body and having an inner wall formed with an arc-shaped urging face that is movable to press the press rod toward the body.

9. The wrench structure in accordance with claim 1, wherein the fist end of the drive rod is formed with a screw bore, and the wrench structure further comprises a mounting head mounted on the first end of the drive rod and formed with the engaging teeth meshing with the ratchet teeth of the rotation member, and a screw member extended through the mounting head and screwed into the screw bore of the drive rod.

10. The wrench structure in accordance with claim 1, wherein the press rod has a plate shape, and the drive rod has a plate shape.

11. A wrench structure, comprising a body, a rotation member, a drive rod, and a press rod, wherein:

the body has an inside formed with an axial receiving hole and has a peripheral wall formed with a transverse limit hole communicating with the receiving hole;

the rotation member is rotatably mounted on the body and has a first end formed with a plurality of ratchet teeth arranged in an annular manner;

the drive rod is movably mounted in the receiving hole of the body and has a first end provided with a plurality of engaging teeth meshing with the ratchet teeth of the rotation member and a second end formed with a stepped hole facing the limit hole of the body and having a first side formed with an arc-shaped press edge and a second side formed with an arc-shaped resting edge; and the press rod is movably mounted in the limit hole of the body and the stepped hole of the drive rod and has a first end formed with an oblique face rested on the press edge of the drive rod and a resting edge rested on the resting edge of the drive rod.

12. The wrench structure in accordance with claim 11, wherein the body has a substantially U-shaped opened end formed with two pivot holes, the first end of the rotation member is pivotally mounted on the opened end of the body and is formed with a pivot hole, and the wrench structure further comprises a pivot shaft extended through the two pivot holes of the body and the pivot hole of the rotation member.

13. The wrench structure in accordance with claim 11, wherein the receiving hole of the body is extended to the opened end of the body.

14. The wrench structure in accordance with claim 11, wherein the rotation member has a second end formed with a driving head.

15. The wrench structure in accordance with claim 11, wherein the press rod has a second end protruded outward from the limit hole of the body.

16. The wrench structure in accordance with claim 11, further comprising an elastic member mounted in the receiving hole of the body and urged between the second end of the drive rod and the body.

17. The wrench structure in accordance with claim 11, wherein the press rod has a plate shape, and the drive rod has a plate shape.

18. The wrench structure in accordance with claim 11, wherein the first end of the drive rod is formed with a screw bore, and the wrench structure further comprises a mounting head mounted on the first end of the drive rod and formed with the engaging teeth meshing with the ratchet teeth of the rotation member, and a screw member extended through the mounting head and screwed into the screw bore of the drive rod.

* * * * *